US008887380B2

(12) United States Patent
Wasilko et al.

(10) Patent No.: US 8,887,380 B2
(45) Date of Patent: Nov. 18, 2014

(54) WIRE STOP FOR A TERMINAL CRIMPING MACHINE

(75) Inventors: John Michael Wasilko, Harrisburg, PA (US); Kerry Joseph Stakem, Hummelstown, PA (US); Brian Keith Weaver, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 811 days.

(21) Appl. No.: 12/429,857

(22) Filed: Apr. 24, 2009

(65) Prior Publication Data

US 2010/0269332 A1 Oct. 28, 2010

(51) Int. Cl.
*H01R 43/04* (2006.01)
*H01R 43/052* (2006.01)

(52) U.S. Cl.
CPC ..... *H01R 43/052* (2013.01)
USPC ..... 29/753; 29/748; 29/33 M; 72/441

(58) Field of Classification Search
CPC ..... H01R 43/0488; H01R 43/055
USPC ..... 29/740, 748–755, 868, 33 M; 72/409.09, 72/413, 712, 184
See application file for complete search history.

(56) References Cited

U.S. PATENT DOCUMENTS

| | | | | | |
|---|---|---|---|---|---|
| 3,484,922 | A | * | 12/1969 | Schwalm et al. | 29/566.2 |
| 3,867,754 | A | | 2/1975 | Koch et al. | |
| 4,272,879 | A | * | 6/1981 | Wigby et al. | 29/566.2 |
| 4,557,048 | A | * | 12/1985 | Cordeiro | 29/863 |
| 4,654,952 | A | | 4/1987 | Baldyga | |
| 4,718,160 | A | * | 1/1988 | Bulanda et al. | 29/566.2 |
| 4,805,278 | A | | 2/1989 | Bulanda et al. | |
| 4,979,291 | A | * | 12/1990 | Phillips et al. | 29/863 |
| 5,131,124 | A | * | 7/1992 | Skotek | 29/33 M |
| 5,784,770 | A | | 7/1998 | Long, Jr. et al. | |
| 6,026,562 | A | * | 2/2000 | McMillin et al. | 29/748 |
| 6,276,052 | B1 | * | 8/2001 | Avenoso et al. | 29/751 |
| 6,298,707 | B1 | * | 10/2001 | Fleps et al. | 72/420 |
| 6,367,148 | B1 | * | 4/2002 | Caveney et al. | 29/753 |

* cited by examiner

*Primary Examiner* — Minh Trinh

(57) ABSTRACT

A wire stop assembly is provided for a terminal crimping machine that crimps a terminal to a wire. The terminal crimping machine includes a crimping zone. The wire stop assembly includes a wire stop member having a stop surface configured to engage the wire to limit an amount of travel of the wire in the crimping zone. The wire stop member is movable relative to the crimping zone in a floating direction. A biasing mechanism is configured to exert a biasing force on the wire stop. The biasing force provides a resistance to the movement of the wire stop member in the floating direction.

11 Claims, 9 Drawing Sheets

WIRE STOP FOR A TERMINAL CRIMPING MACHINE

BACKGROUND OF THE INVENTION

The subject matter described and/or illustrated herein relates generally to machines for crimping electrical terminals to one or more electrical wires, and, more particularly, to a wire stop assembly for a terminal crimping machine.

Terminal crimping machines have been used in the connector industry to effect termination of a single electrical wire or one or more electrical wires of a cable. Some known terminal crimping machines have an interchangeable tooling assembly called an applicator. The applicator may include opposing forming tools for crimping a terminal to one or more electrical wires. For example, the applicator may include an anvil and an applicator ram that holds a crimping tool-head that opposes the anvil. In operation, a combination of the terminal and the electrical wire(s) is positioned on the anvil. The applicator ram is then driven toward the anvil until the crimping tool-head engages the terminal. Engagement of the terminal between the anvil and the crimping tool-head crimps the terminal to the wire(s).

Some known terminal crimping machines include a wire stop that engages the wire(s) to position the wire(s) relative to the terminal. Specifically, the wire stop limits an amount of travel of the wire(s) as the wire(s) is being positioned on the terminal. Accordingly, the wire(s) does not travel past the crimping location of the terminal. At least some known wire stops are fixed in place relative to the anvil. As the terminal is compressed between the anvil and the crimping tool-head, the material of the wire(s) and/or the terminal may extrude into the wire stop and/or between the wire stop and other structures of the terminal crimping machine. Such extrusion of the wire(s) and/or terminal may damage the wire stop and/or may cause the crimped terminal and wire assembly to jam within the terminal crimping machine.

There is a need for a terminal crimping machine wherein a crimped terminal and wire assembly may be less likely to be jammed due to extrusion of the terminal and/or the wire(s) during crimping thereof. There is a need for a wire stop for a terminal crimping machine that may be less likely to be damaged and/or worn by extrusion of a terminal and/or one or more wires during crimping thereof.

BRIEF DESCRIPTION OF THE INVENTION

In one embodiment, a wire stop assembly is provided for a terminal crimping machine that crimps a terminal to a wire. The terminal crimping machine includes a crimping zone. The wire stop assembly includes a wire stop member having a stop surface configured to engage the wire to limit an amount of travel of the wire in the crimping zone. The wire stop member is movable relative to the crimping zone in a floating direction. A biasing mechanism is configured to exert a biasing force on the wire stop. The biasing force provides a resistance to the movement of the wire stop member in the floating direction.

In another embodiment, a terminal crimping machine is provided for crimping a terminal to a wire. The terminal crimping machine includes a crimping zone and a wire stop member having a stop surface configured to engage the wire to limit an amount of travel of the wire in the crimping zone. The wire stop member is configured to move relative to the crimping zone in a floating direction when the wire stop member is engaged by a portion of at least one of the wire and the terminal that has extruded during crimping of the terminal to the wire.

DETAILED DESCRIPTION OF THE INVENTION

Figure 1:
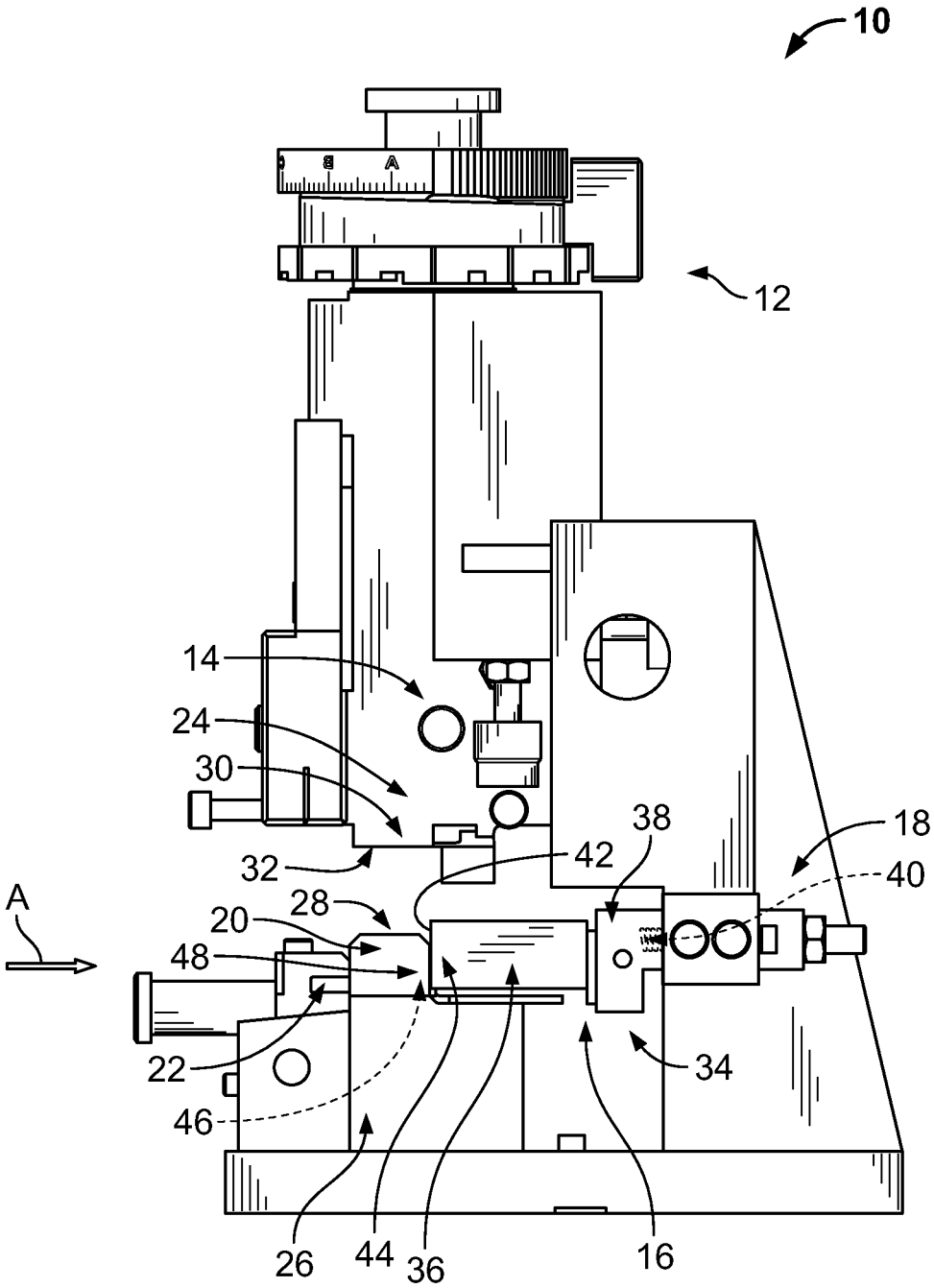
FIG. 1 is a side elevational view of an exemplary embodiment of a terminal crimping machine.
Figure 2:
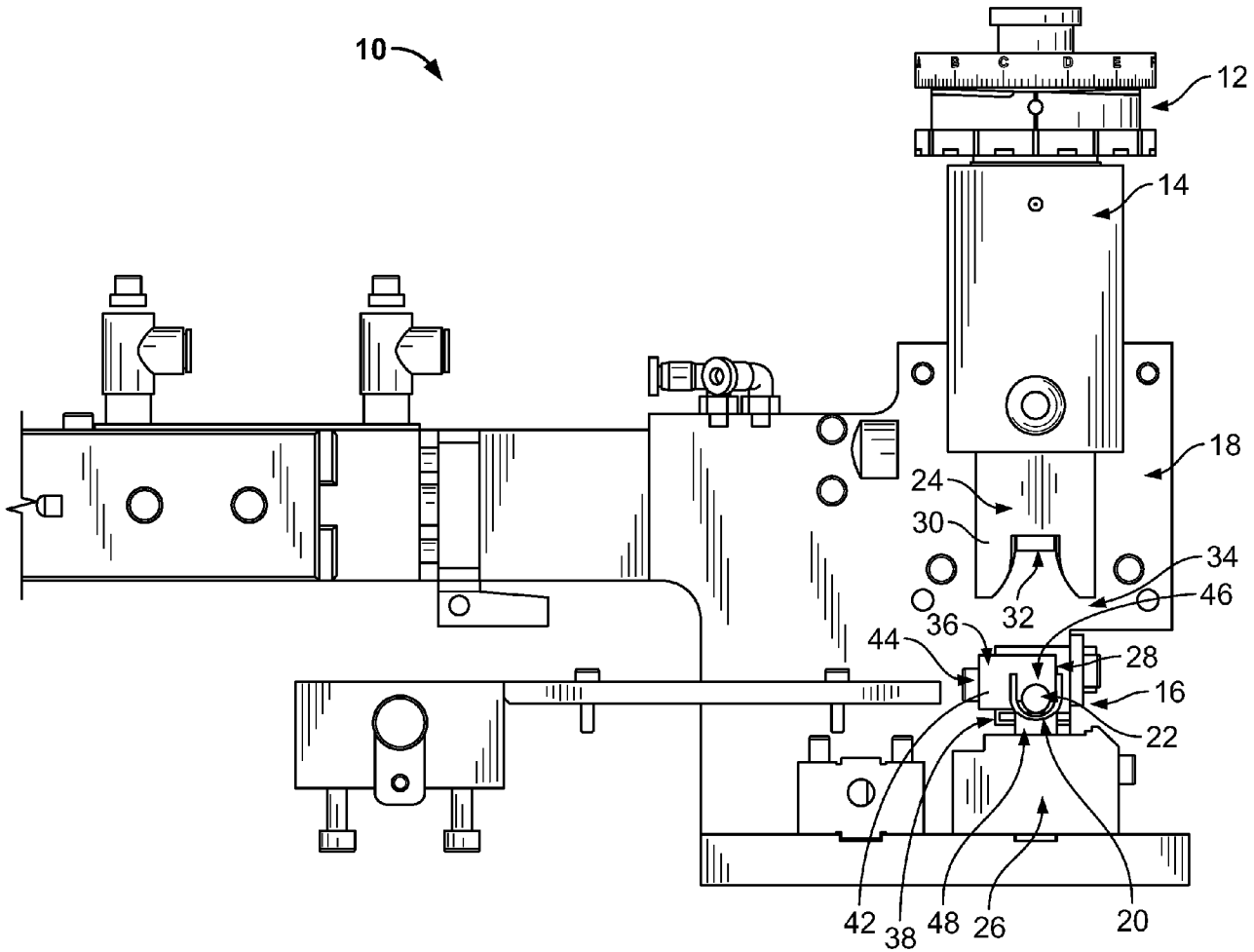
FIG. 2 is a front elevational view of the terminal crimping machine shown in FIG. 1.

FIG. 1 is a side elevational view of an exemplary embodiment of a terminal crimping machine 10. FIG. 2 is a front elevational view of the terminal crimping machine 10. The terminal crimping machine 10 includes a terminator assembly 12, an applicator assembly 14, and a wire stop assembly 16. A portion of a housing 18 of the applicator assembly 14 has been removed from FIGS. 1 and 2 for clarity. The terminal crimping machine 10 is used to crimp a terminal 20 to a single electrical wire 22, or one or more electrical wires 22 of a cable (not shown). The terminal crimping machine 10 will be described and illustrated herein with reference to crimping the terminal 20 to a single electrical wire 22. However, it should be understood that the terminal 20 may be crimped to a plurality of electrical wires 22, for example a plurality of electrical wires 22 of a single cable (not shown).

The terminator assembly 12 includes a terminator drive system (not shown) that drives an applicator ram 24 of the applicator assembly 14. The applicator assembly 14 also includes an anvil 26 positioned in a crimping zone 28 of the terminal crimping machine 10. In the exemplary embodiment, the anvil 26 defines a bottom of the crimping zone 28. The applicator ram 24 includes an end 30 having a crimping tool-head 32 extending therefrom. The anvil 26 and/or the crimping tool-head 32 may include a size and/or a shape that is complementary with the terminal 20 and/or the electrical wire 22. The anvil 26 and/or the crimping tool-head 32 may include a size and/or shape configured to form the terminal 20 and/or the electrical wire 22 into a predetermined crimped size and/or shape. In operation, a combination of the terminal 20 and the electrical wire 22 is positioned on the anvil 26. Specifically, the terminal 20 is positioned on the anvil 26 and the electrical wire 22 is fed into the crimping zone 28 in the direction of the arrow A such that the electrical wire 22 is positioned on the terminal 20. The terminator assembly 12 drives the applicator ram 24 toward the anvil 26 until the combination of the terminal 20 and the electrical wire 22 is engaged between the crimping tool-head 32 and the anvil 26. As the applicator ram 24 is driven toward the anvil 26, compression of the terminal 20 about the electrical wire 22 crimps the terminal to the electrical wire 22.

As described above, the terminal crimping machine 10 includes a wire stop assembly 16. The wire stop assembly 16 is arranged adjacent the crimping zone 28 of the terminal crimping machine 10. In the exemplary embodiment, a portion of the wire stop assembly 16 is received within a cavity 34 of the applicator housing 18 of the applicator assembly 14. As described above, a portion of the housing 18 is not shown herein to illustrate reception of the wire stop assembly 16 within the cavity 34. Alternatively, any portion of the wire stop assembly 16 may be positioned at any location of the terminal crimping machine 10 that enables the wire stop assembly 16 to function as described and/or illustrated herein.

In the exemplary embodiment, the wire stop assembly 16 includes a wire stop member 36, a wire stop holder 38 that holds the wire stop member 36, and a biasing mechanism 40 (not shown in FIG. 2) that will be described in more detail below. The biasing mechanism 40 is illustrated more clearly in FIGS. 3-5. The wire stop member 36 positions the electrical wire 22 relative to the terminal 20 by limiting an amount of travel of the electrical wire 22 in the crimping zone 28. In other words, the wire stop member 36 limits an amount of travel of the electrical wire 22 in a direction A (not shown in FIG. 2) as the electrical wire 22 is fed into the crimping zone 28. Specifically, the wire stop member 36 includes a stop surface 42. As the electrical wire 22 is fed into the crimping zone 28, the stop surface 42 engages the electrical wire 22 such that a predetermined crimping location along the electrical wire 22 does not travel past a predetermined crimping location of the terminal 20. In the exemplary embodiment, the stop surface 42 is located on an end 44 of the wire stop member 36 and the stop surface 42 engages an end 46 of the electrical wire 22. Alternatively, the stop surface 42 engages any other portion of the electrical wire 22. Moreover, the stop surface 42 may alternatively be located anywhere else on the wire stop member 36 than is illustrated and/or described herein. In the exemplary embodiment, the end 46 of the electrical wire 22 is crimped to an end 48 of the terminal 20. However, the predetermined crimping locations of the terminal 20 and the electrical wire 22 may each have any other location on the respective terminal 20 and electrical wire 22 than is illustrated and/or described herein.

Figure 3:
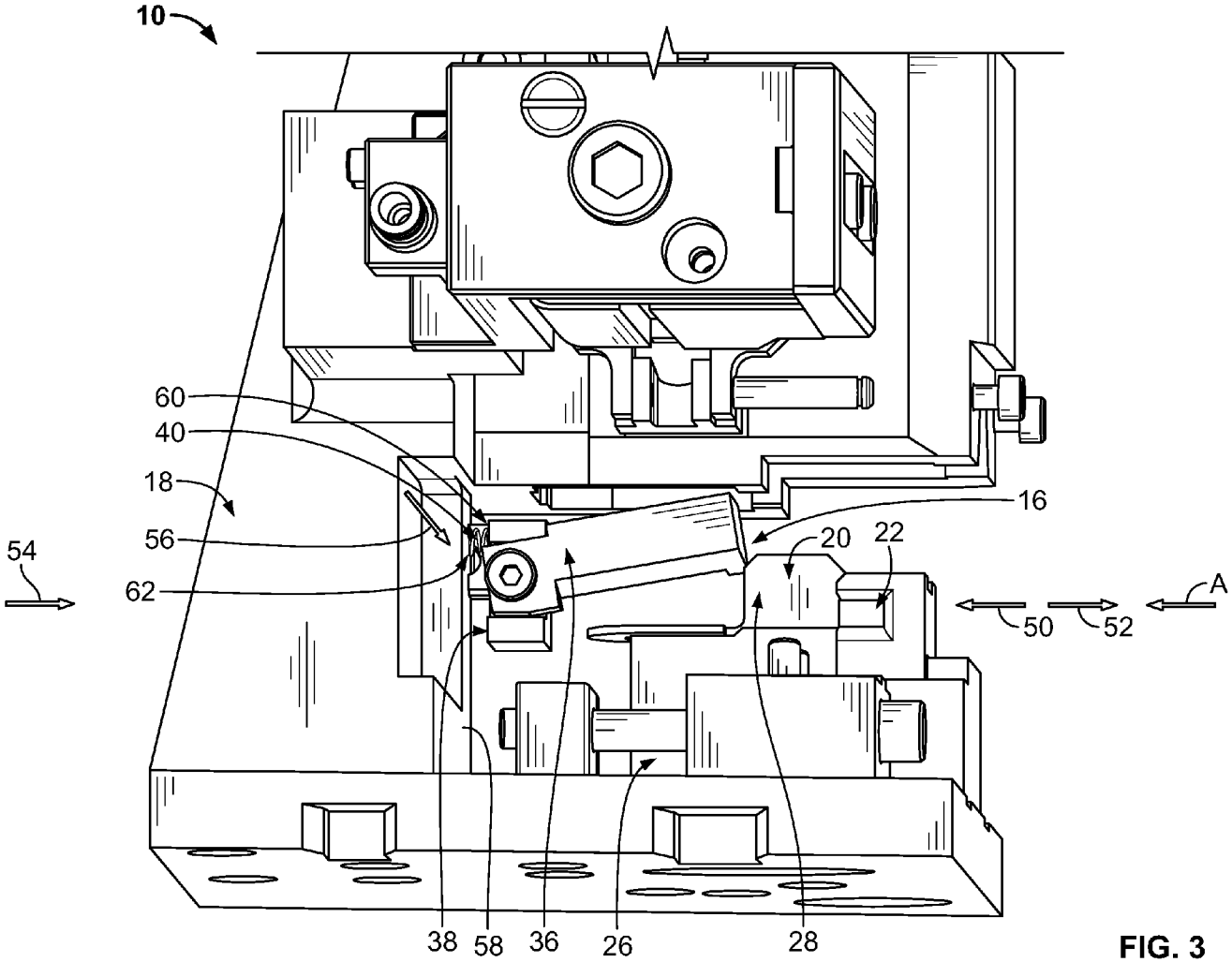
FIG. 3 is a perspective view of a portion of the terminal crimping machine shown in FIGS. 1 and 2.

FIG. 3 is a perspective view of a portion of the terminal crimping machine 10. Similar to FIGS. 1 and 2, a portion of the applicator housing 18 has been removed from FIG. 3 for clarity. The wire stop member 36 is movable relative to the crimping zone 28 in a floating direction 50. The wire stop member 36 is also movable in a return direction 52. The biasing mechanism 40 is configured to exert a biasing force on the wire stop member 36. The biasing force exerted on the wire stop member 36 by the biasing mechanism 40 provides a resistance to the movement of the wire stop member 36 in the floating direction 50. The biasing force exerted on the wire stop member 36 by the biasing mechanism 40 provides assistance to the movement of the wire stop member 36 in the return direction 52.

In the exemplary embodiment, the floating direction 50 is substantially linear and is substantially parallel to the direction A of the feed of the electrical wire 22 into the crimping zone 28. Alternatively, the floating direction 50 may be any other direction than is shown, including any non-linear directions. Similar to the floating direction 50, in the exemplary embodiment, the return direction 52 is substantially linear and is substantially parallel to the direction A of the feed of the electrical wire 22 into the crimping zone 28. Alternatively, the return direction 52 may be any other direction than is shown, including any non-linear directions.

As described above, the biasing force exerted on the wire stop member 36 by the biasing mechanism 40 provides a resistance to the movement of the wire stop member 36 in the floating direction 50, and provides assistance to the movement of the wire stop member 36 in the return direction 52. In the exemplary embodiment, the biasing force acts in a direction 54 that is substantially opposite the exemplary floating direction 50. In other words, the biasing force acts in a direction 54 that is substantially aligned with the exemplary return direction 52. Alternatively, the biasing force may act in any other direction that enables the biasing force to provide the resistance and assistance to the movement of the wire stop member 36 in the respective floating and return directions 50 and 52. For example, the biasing force may alternatively act in a direction 56 that is non-parallel with the exemplary floating and return directions 50 and 52, respectively. The biasing force is not limited to acting in the directions 54 and/or 56. Rather, the biasing force may act in any direction relative to any floating and return directions that enables the biasing force to provide the resistance and assistance to the movement of the wire stop member 36 in the respective floating and return directions. The biasing force may be selected to provide any predetermined amount of resistance(s) to the movement of the wire stop member 36 in the floating direction 50, whether or not the biasing force is linear relative to an amount of deflection of the biasing mechanism 40. Similarly, the biasing force may be selected to provide any predetermined amount of assistance to the movement of the wire stop member 36 in the return direction 52, whether or not the biasing force is linear relative to an amount of deflection of the biasing mechanism 40. In the exemplary embodiment, the predetermined amount of resistance provided by the biasing force is greater than a force exerted by the electrical wire 22 on the stop surface 42 as the electrical wire 22 is fed into the crimping zone 28.

Figure 4:
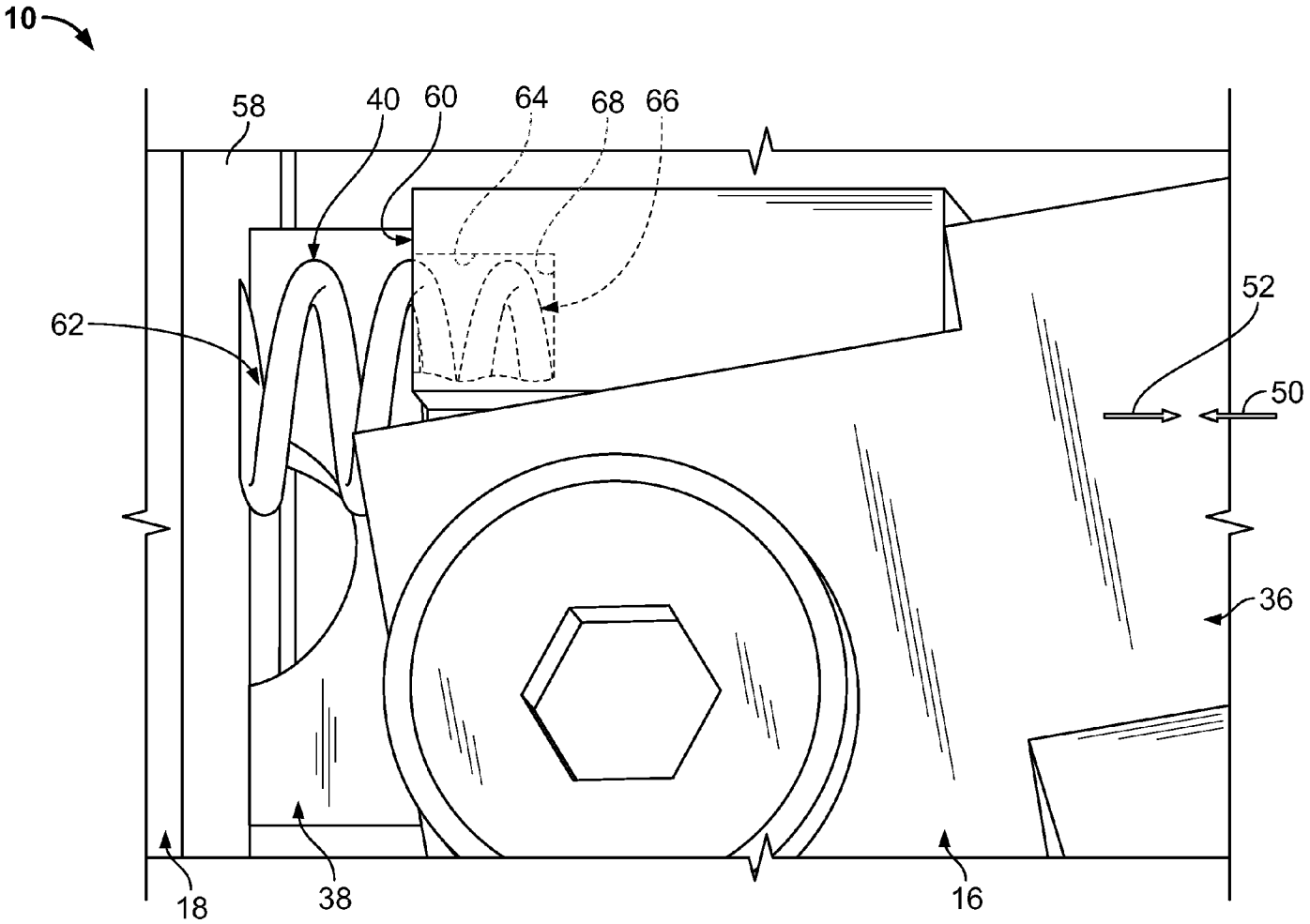
FIG. 4 is an enlarged perspective view of a portion of the terminal crimping machine shown in FIGS. 1-3 illustrating an exemplary embodiment of a biasing mechanism of the terminal crimping machine.

FIG. 4 is an enlarged perspective view of a portion of the terminal crimping machine 10 shown in FIG. 3 illustrating the biasing mechanism 40. Referring to FIGS. 3 and 4, the biasing mechanism 40, and/or any intervening connection structures (not shown) thereof, may engage any portion of the wire stop assembly 16 and any other structure that enables the biasing mechanism 40 to provide the biasing forces described and/or illustrated herein. In the exemplary embodiment, the biasing mechanism 40 engages the applicator housing 18 and the wire stop holder 38 such that the biasing mechanism 40 is operatively connected between the applicator housing 18 and the wire stop member 36. Specifically, the applicator housing 18 includes a wall 58 that opposes a portion 60 of the wire stop holder 38. The biasing mechanism 40 includes an end 62 that engages the wall 58 of the applicator housing 18. The end 62 of the biasing mechanism 40, and/or any intervening connection structure(s), may be connected to the wall 58 of the applicator housing 18 using any arrangement, structure, means, and/or the like. Examples of connecting the end 62 to the wall 58 include, but are not limited to, using an adhesive (not shown), being welded (not shown), using one or more threaded and/or other type(s) of fasteners (not shown), being received within an opening (not shown) of the wall 58, and/or the like. In alternative embodiments, the biasing mechanism 40, and/or any intervening connection structure(s), may engage any other structure besides the wall 58 that enables the biasing mechanism 40 to provide the biasing forces described and/or illustrated herein.

Figure 5:
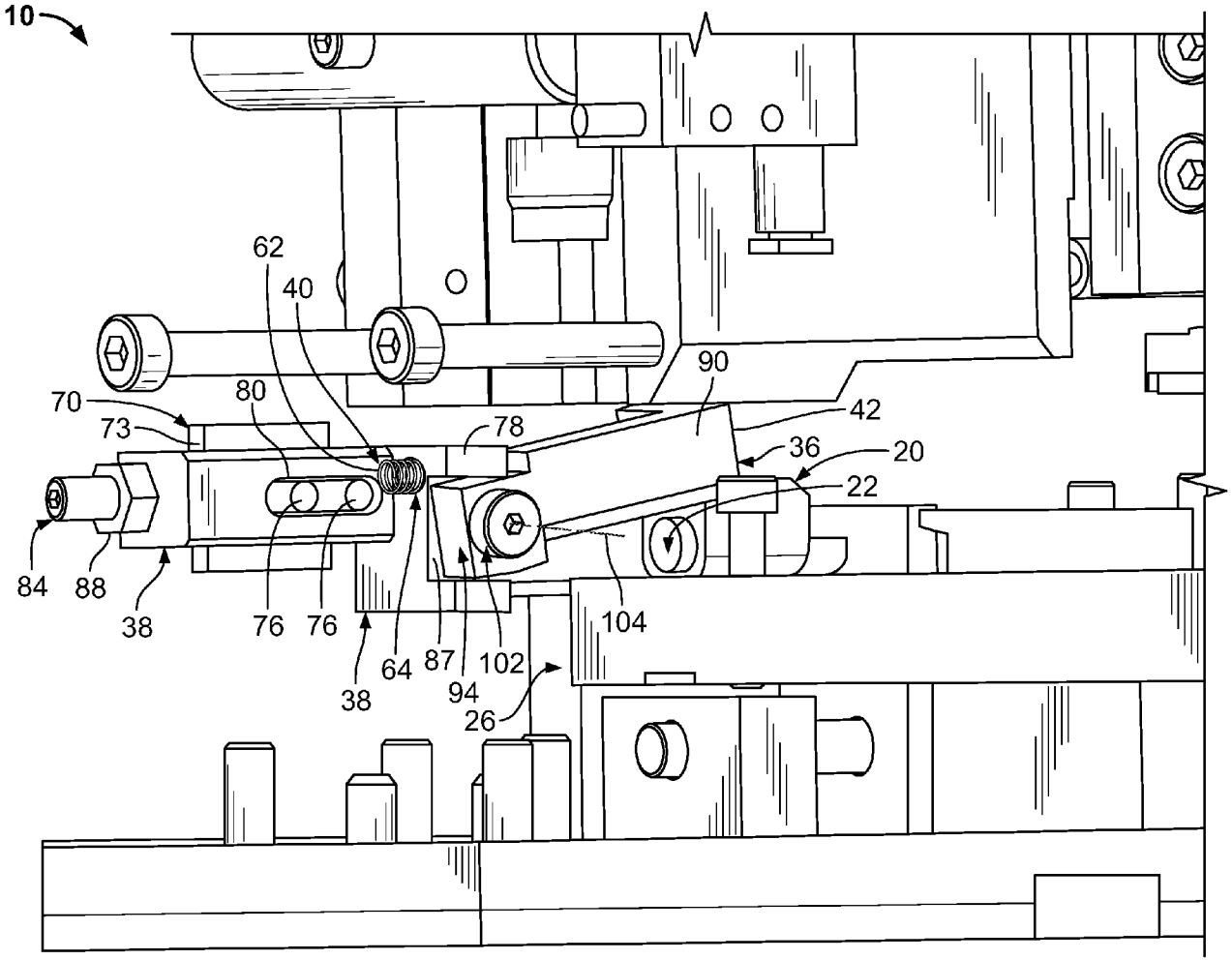
FIG. 5 is a perspective view of a portion of the terminal crimping machine shown in FIGS. 1-4 with an applicator housing being removed therefrom.

FIG. 5 is a perspective view of a portion of the terminal crimping machine 10 with the applicator housing 18 completely removed therefrom. Referring to FIGS. 4 and 5, as described above, in the exemplary embodiment the biasing mechanism 40 engages the wire stop holder 38 such that the biasing mechanism 40 is operatively connected between the applicator housing 18 (not shown in FIG. 5) and the wire stop member 36. The biasing mechanism 40 exerts the biasing force on the wire stop member 36 via engagement of the biasing mechanism 40 and the wire stop holder 38. In the exemplary embodiment, the wire stop member 36 is held by the wire stop holder 38 such that the wire stop holder 38 moves along with the wire stop member 36 in the floating and return directions 50 and 52 (not shown in FIG. 5), respectively.

The biasing mechanism 40, and/or any intervening connection structure(s), may engage any portion of the wire stop holder 38 that enables the biasing mechanism 40 to provide the biasing forces described and/or illustrated herein. In the exemplary embodiment, the wire stop holder 38 includes an opening 64 that receives a portion of the biasing mechanism 40 therein. A portion of the wire stop holder 38 has been broken away in FIG. 4 to illustrate the opening 64. The biasing mechanism 40 includes an end 66 (not visible in FIG. 5) that is opposite the end 62. The opening 64 within the wire stop holder 38 includes a bottom wall 68 (not visible in FIG. 5). The end 66 of the biasing mechanism 40 engages the bottom wall 68 of the opening 64 such that the biasing mechanism 40 is engaged between the bottom wall 68 and the wall 58 (not shown in FIG. 5) of the applicator housing 18. Engagement of the biasing mechanism 40 between the wall 58 of the applicator housing 18 and the bottom wall 68 of the wire stop holder 38 enables the biasing mechanism 40 to exert the biasing force on the wire stop member 36.

In alternative embodiments, the biasing mechanism 40 may engage any other portion of the wire stop holder 38 besides the bottom wall 68 that enables the biasing mechanism 40 to provide the biasing forces described and/or illustrated herein. In some alternative embodiment, the wire stop holder 38 does not include the opening 64 such that the biasing mechanism 40 is not received therein. Moreover, in alternative embodiments, the biasing mechanism 40, and/or any intervening connection structure(s), may directly engage the wire stop member 36, whether or not the wire stop holder 38 moves along with the wire stop member 36 in the floating and return directions 50 and 52, respectively.

In the exemplary embodiment, the biasing mechanism 40 is a helical spring. However, in addition or alternative to the helical spring, the biasing mechanism 40 may include any other type of biasing mechanism (whether or not the biasing mechanism 40 is a spring) that enables the biasing mechanism 40 to function as described and/or illustrated herein, such as, but not limited to, a leaf spring (not shown), a damper (not shown), and/or the like. In such an embodiment wherein the biasing mechanism 40 is a damper, the biasing mechanism 40 may only provide the biasing force in response to the movement of the wire stop member 36 in the floating direction 50. In other words, in such an embodiment wherein the biasing mechanism 40 is a damper, the biasing mechanism 40 may not provide assistance to the movement of the wire stop member 36 in the return direction 52. Although only one biasing mechanism 40 is shown, the wire stop assembly 16 may include any number of biasing mechanisms 40. The wire stop assembly 16 optionally includes one or more dampers (not shown) that cooperate with the biasing mechanism 40 during the movement of the wire stop member 36 in the floating and return directions 50 and 52, respectively.

Figure 6:
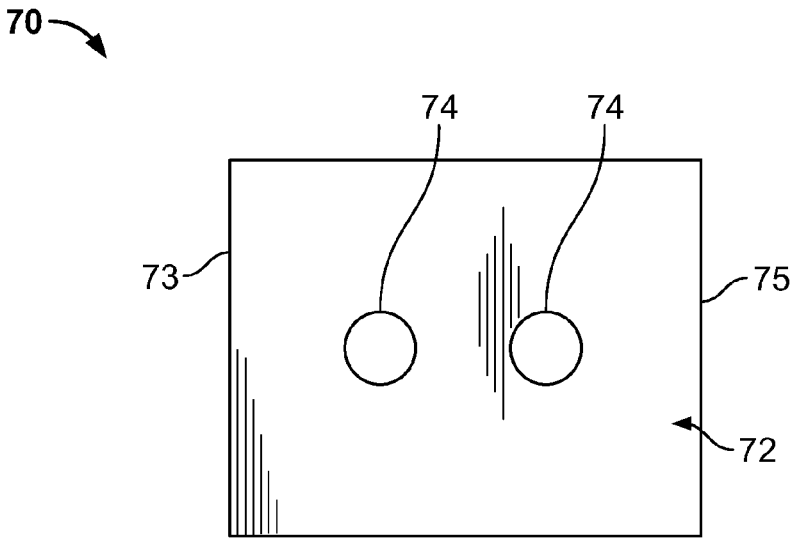
FIG. 6 is a side elevational view of an exemplary embodiment of a wear plate of the terminal crimping machine shown in FIGS. 1-5.

Referring to FIG. 5, in the exemplary embodiment, the wire stop holder 38 is mounted on a wear plate 70 that is fixedly connected to the applicator housing 18 (FIGS. 1-4). The connection between the wear plate 70 and the applicator housing 18 is not shown herein. FIG. 6 is a side elevational view of an exemplary embodiment of the wear plate 70. The wear plate 70 includes a body 72 having a plurality of openings 74 extending through the body 72 and a pair of opposite side surfaces 73 and 75. As will be described below, the openings 74 are each configured to receive a fastener 76 (FIGS. 5 and 8) for connecting the wear plate 70 to the wire stop holder 38 (FIGS. 1-5, 8, and 10). Although two openings 74 are shown, the wear plate 70 may include any number of openings 74 for receiving any number of fasteners 76.

Figure 7:
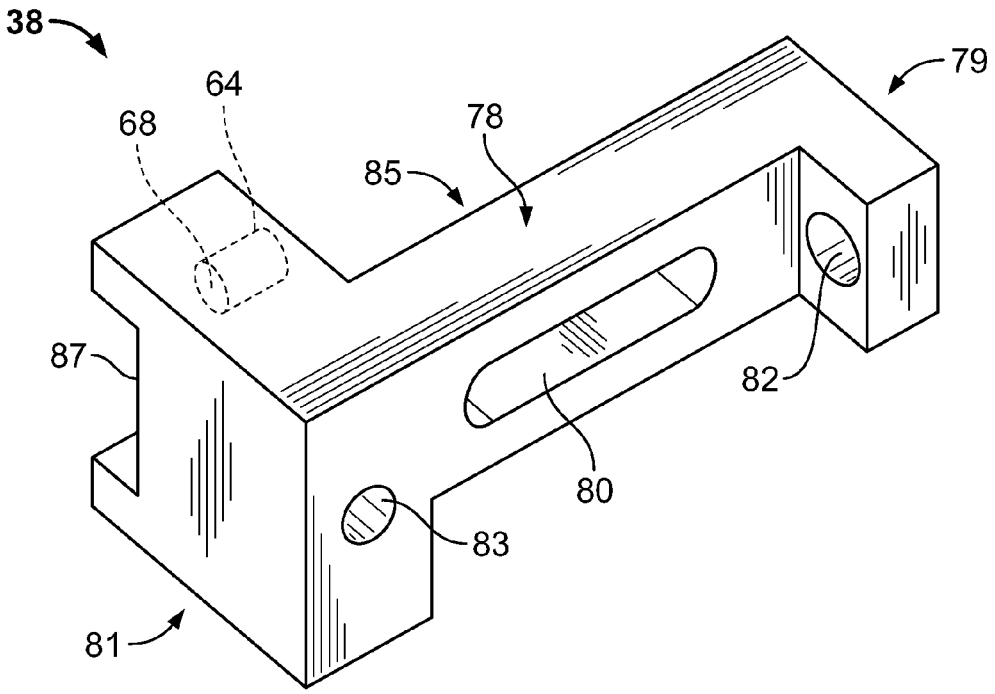
FIG. 7 is a perspective view of an exemplary embodiment of a wire stop holder of the terminal crimping machine shown in FIGS. 1-5.

FIG. 7 is a perspective view of an exemplary embodiment of the wire stop holder 38. The wire stop holder 38 includes a body 78 extending between a pair of opposite ends 79 and 81. The body includes a slot 80 extending through the body 78. As will be described below, the slot 80 is configured to receive the fasteners 76 (FIGS. 5 and 8) for connecting the wear plate 70 (FIGS. 5, 6, and 8) to the wire stop holder 38. The body 78 of the wire stop holder 38 also includes a threaded opening 82 extending through the body 78 adjacent the end 79. As will be described below, the threaded opening 82 is configured to receive an adjustment screw 84 (FIGS. 5 and 8) therein for adjusting a resting position of the wire stop member 36 (FIGS. 1-5 and 8-10). A threaded opening 83 extends through the body adjacent the end 81 for mounting the wire stop member 36 on the wire stop holder 38.

The body 78 of the wire stop holder 38 includes a side 85 that faces the wire stop member 36 when the wire stop member 36 is mounted on the wire stop holder 38. The side 85 includes a channel 87 that receives a portion of the wire stop member 36 therein, as will be described below. The threaded opening 83 communicates with the channel 87. The opening 64 that receives the biasing mechanism 40 (FIGS. 1, 3-5, and 10) can be seen in FIG. 7 extending into the body 78 to the bottom wall 68 thereof.

Although one slot 80 is shown, the wire stop holder 38 may include any number of slots 80 for receiving any number of fasteners 76. Moreover, the wire stop holder 38 may include any number of openings 82 for receiving any number of adjustment screws 84 and may include any number of openings 83 for mounting the wire stop member 36 on the wire stop holder 38. Although the channel 87 is shown on the end 81 of the wire stop holder 38, the channel 87 may be located anywhere on the body 78 of the wire stop holder 38.

Figure 8:
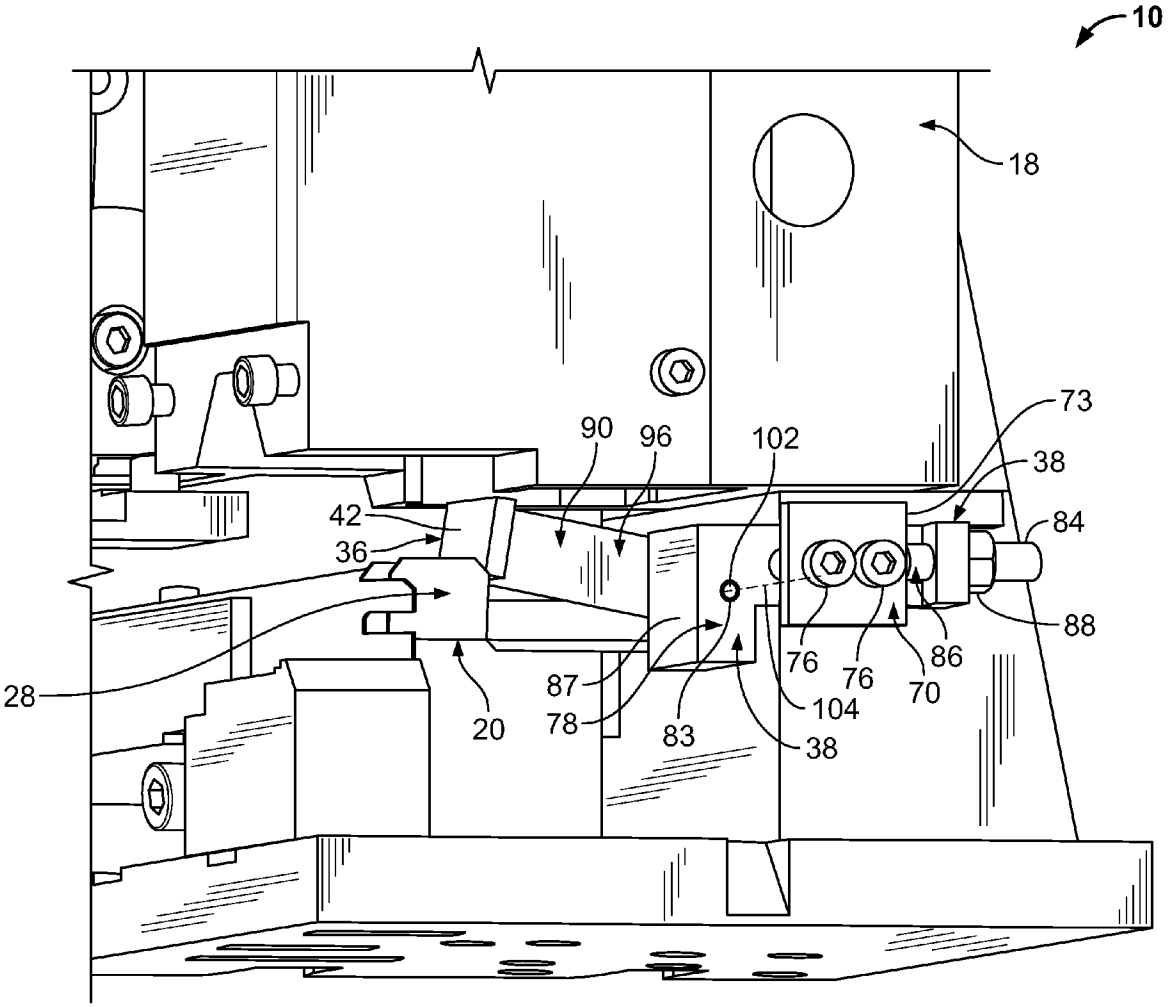
FIG. 8 is a perspective view of a portion of the terminal crimping machine shown in FIGS. 1-5 viewed from an opposite side of the terminal crimping machine than is shown in FIG. 5.

FIG. 8 is a perspective view of a portion of the terminal crimping machine 10 as viewed from an opposite side of the terminal crimping machine 10 than is shown in FIG. 5. The electrical wire 22 and the anvil 26 are not shown in FIG. 8. Referring now to FIGS. 5 and 8, the wear plate 70 is connected to the wire stop holder 38 by the fasteners 76. Specifically, each of the fasteners 76 is received within a corresponding one of the openings 74 (FIG. 6) of the wear plate 70 and through the slot 80 (not visible in FIG. 8) of the wire stop holder 38. The fasteners 76 are free to move within the slot 80 to enable relative movement between the wear plate 70 and the wire stop holder 38. Because the wear plate 70 is fixedly connected to the applicator housing 18, the wear plate 70 does not move with the wire stop member 36 and the wire stop holder 38 in the floating and return directions 50 (FIGS. 3, 4, and 10) and 52 (FIGS. 3 and 4), respectively. Optionally, one or more bearings (not shown) cooperate with the fasteners 76 and/or the body 78 of the wire stop holder 38 to facilitate relative movement between the wear plate 70 and the wire stop holder 38. In alternative embodiments, relative movement between the wear plate 70 and the wire stop holder 38 may be provided using any other arrangement, structure, means, and/or the like than the slot 80, the openings 74, the bearing(s), and/or the fasteners 76.

In the exemplary embodiment, the fasteners 76 are threaded bolts that each cooperate with a threaded nut (not shown) to hold the wear plate 70 on the wire stop holder 38. Alternatively, the fasteners 76 may be any other type of fastener capable of holding the wear plate 70 on the wire stop holder 38 as is described and/or illustrated herein. Although two fasteners 76 are shown, any number of fasteners 76 may be used to hold the wear plate 70 on the wire stop holder 38.

In the exemplary embodiment, a resting position of the stop surface 42 of the wire stop member 36 is adjustable in the floating and return directions 50 and 52. As used herein, the term "resting position" of the stop surface 42 is intended to mean the position of the stop surface 42 before the electrical wire 22 (not shown in FIG. 8) is fed into the crimping zone 28 and after a crimped assembly of the terminal 20 and the electrical wire 22 is removed from the crimping zone 28. For example, when the biasing mechanism 40 (not visible in FIG. 8) includes a spring, the spring is in a natural undeformed state when the stop surface 42 is in the resting position. The resting position of the stop surface 42 is selected to facilitate locating the electrical wire 22 relative to the predetermined crimping location of the terminal 20 in the crimping zone 28.

To select the resting position of the stop surface 42, the adjustment screw 84 is received through the opening 82 (FIG. 7) of the wire stop holder 38 such that the adjustment screw 84 is threadably engaged with the opening 82. A position of the adjustment screw 84 relative to the wire stop holder 38 can be selected by threading the adjustment screw into or out of the opening 82. An end 86 (not visible in FIG. 5) of the adjustment screw 84 abuts the side surface 73 of the wear plate 70. Because the wear plate 70 is fixedly mounted to the applicator housing 18, adjustment of the position of the adjustment screw 84 relative to the wire stop holder 38 moves the wire stop holder 38 and the wire stop member 36 in the floating or return direction 50 and 52, respectively. A lock nut 88 is provided for locking the position of the adjustment screw 84 relative to the wire stop holder 38, thereby locking the resting position of the stop surface 42 of the wire stop member 36. When locked in the resting position, the wire stop member 36 is still movable in the floating direction 50 against the resistance of the biasing mechanism 40 and is still movable in the return direction 52 with the assistance of the biasing mechanism 40.

In alternative embodiments, adjustment of the resting position of the stop surface 42 may be provided using any other arrangement, structure, means, and/or the like than the adjustment screw 84, the opening 82, and/or the wear plate 70. Although one adjustment screw 84 is shown, any number of adjustment screws 84 may be used.

Figure 9:
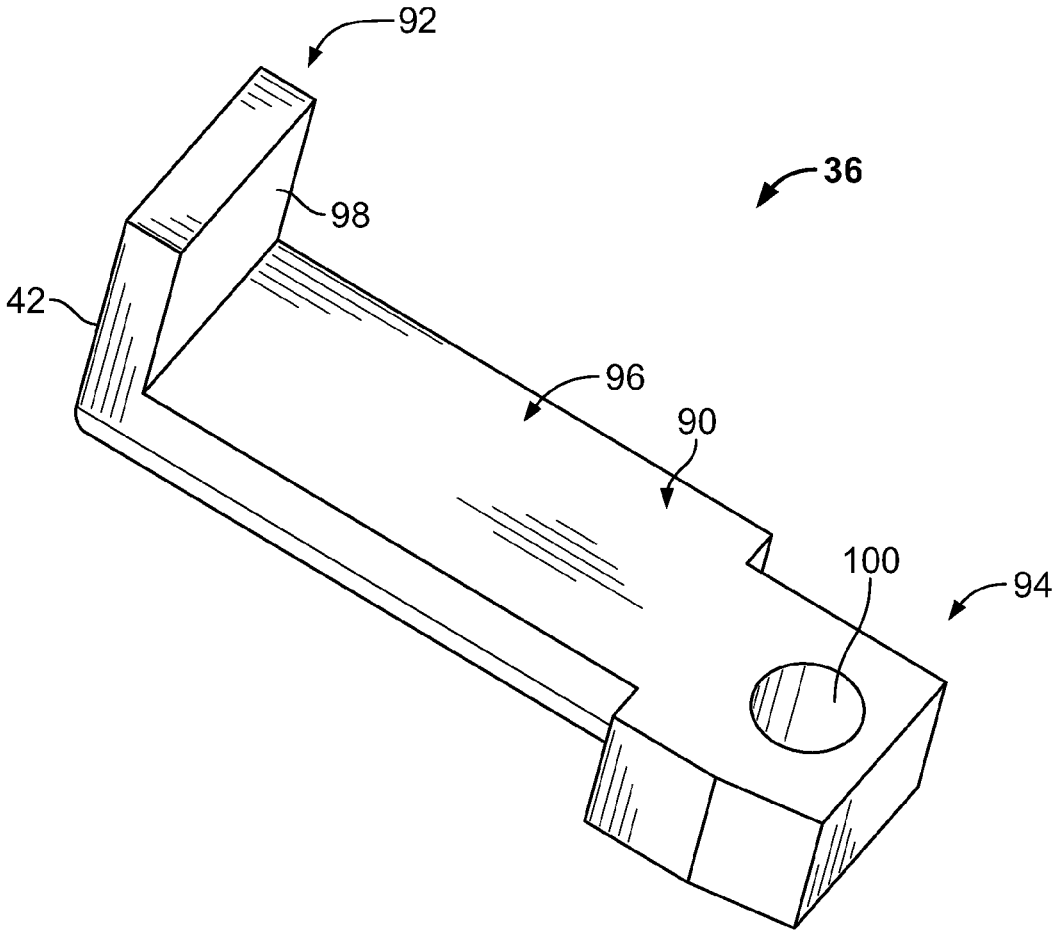
FIG. 9 is a perspective view of an exemplary embodiment of a wire stop member of the terminal crimping machine shown in FIGS. 1-5 and 8.

FIG. 9 is a perspective view of the wire stop member 36. The wire stop member 36 includes a body 90 that extends between a pair of opposite ends 92 and 94. The body 90 includes a side 96 that faces the wire stop holder 38 (FIGS. 1-5, 7, 8, and 10) when the wire stop member 36 is held by the wire stop holder 38. The end 92 includes an extension 98 that includes the stop surface 42. At least a portion of the end 94 is received within the channel 87 (FIGS. 5, 7, and 8) of the wire stop holder 38 when the wire stop member 36 is mounted on the wire stop holder 38. The body 90 includes an opening 100 that extend through the end 94. As will be described below, the opening 100 enables mounting of the wire stop member 36 on the wire stop holder 38. Although one opening 100 is shown, the wire stop member 36 may include any number of openings 100 for mounting the wire stop member 36 on the wire stop holder 38.

Referring to FIGS. 5 and 8, in the exemplary embodiment the wire stop member 36 is mounted on the wire stop holder 38 such that the wire stop member 36 can rotate relative to the wire stop holder 38. FIGS. 3-5 and 8 illustrate the wire stop member 36 in a rotated position, while FIGS. 1 and 2 illustrate the wire stop member 36 in a non-rotated position. The wire stop member 36 is positioned on the wire stop holder 38 such that the side 96 (not visible in FIG. 5) faces the wire stop holder 38 and such that the end 94 is received within the channel 87 (not visible in FIG. 8) of the wire stop holder 38. Moreover, the opening 100 (FIG. 9) of the wire stop member 36 is aligned with the threaded opening 83 (not visible in FIG. 5) of the wire stop holder 38. A fastener 102 is received within the openings 100 and 83. The fastener 102 is threadably connected to the opening 83 of the wire stop holder 38 to mount the wire stop member 36 on the wire stop holder 38. The fastener 102 is received within the opening 100 of the wire stop member 36 such that the wire stop member 36 can rotate about the fastener 102 and an axis of rotation 104 relative to the wire stop holder 38. Specifically, the opening 100 is sized and shaped relative to the fastener 102 to allow the wire stop member 36 to rotate about the fastener 102. One or more bearings (not shown) optionally cooperate with the fastener 102 and/or the end 94 of the wire stop member 36 to facilitate rotation of the wire stop member 36 about the fastener 102. The channel 87 of the wire stop holder 38 is sized and/or shaped to enable the end 94 of the wire stop member 36 to rotate therein. Although the axis of rotation 104 of the wire stop member 36 is shown herein as being adjacent the end 94 of the wire stop member 36, the wire stop member 36 may rotate about an axis of rotation having any other location on the wire stop member 36.

In alternative embodiments, rotation of the wire stop member 36 relative to the wire stop holder 38 may be provided using any other arrangement, structure, means, and/or the like than the fastener 102, the openings 100 and/or 83, and/or the bearing(s). Moreover, although shown as a threaded fastener, the fastener 102 may be any other type of fastener. Although one fastener 102 is shown, any number of fasteners 102 may be used. Although the fastener 102 is threadably engaged with the threaded opening 83, alternatively a nut (not shown) may be threadably engaged with the fastener 102 (whether or not the opening 83 is threaded).

Referring to FIG. 1, in operation, a combination of the terminal 20 and the electrical wire 22 is positioned on the anvil 26. Specifically, the terminal 20 is positioned on the anvil 26 and the electrical wire 22 is fed into the crimping zone 28 in the direction of the arrow A such that the electrical wire 22 is positioned on the terminal 20. As the electrical wire 22 is fed into the crimping zone 28, the end 46 of the electrical wire 22 engages the stop surface 42 of the wire stop member 36 to facilitate locating the electrical wire 22 relative to the predetermined crimping location of the terminal 20. The terminator assembly 12 drives the applicator ram 24 toward the anvil 26 until the assembly of the terminal 20 and the electrical wire 22 is engaged between the crimping tool-head 32 and the anvil 26. As the applicator ram 24 is driven toward the anvil 26, compression of the terminal 20 about the electrical wire 22 crimps the terminal to the electrical wire 22.

Figure 10:
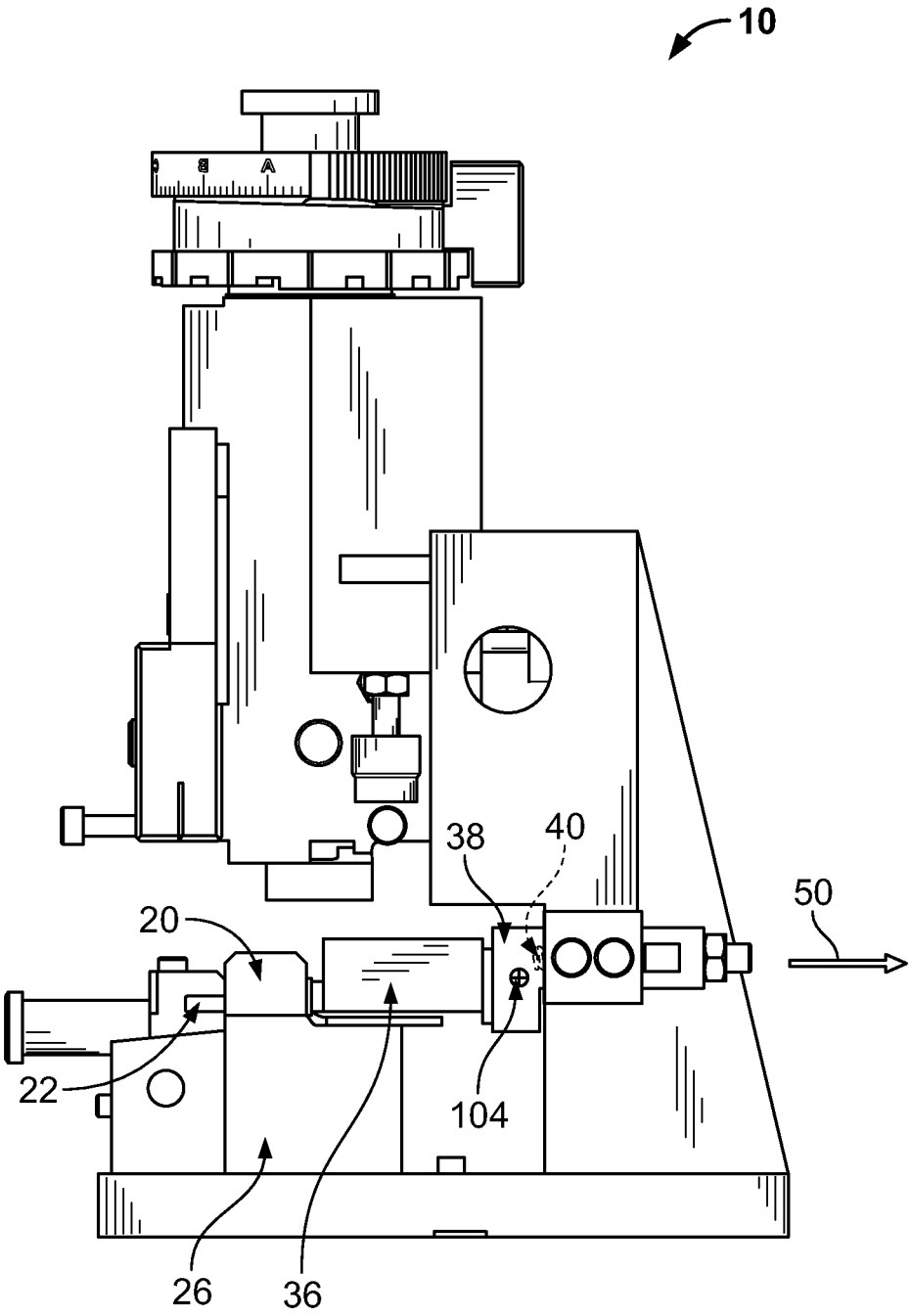
FIG. 10 is a side elevational view of the terminal crimping machine shown in FIGS. 1-5 and 8 illustrating movement of the wire stop member shown in FIG. 9 in an exemplary embodiment of a floating direction.

FIG. 1 illustrates the wire stop member 36 in the resting position. As the terminal 20 is crimped to the electrical wire 22, engagement between the wire stop member 36 and the electrical wire 22 and/or the terminal 20 may sometimes cause the wire stop member 36 to move in the floating direction 50 away from the resting position. For example, during crimping, the electrical wire 22 and/or the terminal 20 may extrude against and/or around the stop surface 42 of the wire stop member 36, which may cause the wire stop member 36 to move in the floating direction 50 away from the resting position. FIG. 10 illustrates the wire stop member 36 having moved in the floating direction 50 away from the resting position via extrusion of the electrical wire 22. Besides extrusion, and for example, a misalignment (e.g., a jam) of a crimped assembly of the terminal 20 and the electrical wire 22 may sometimes cause the wire stop member 36 to move in the floating direction 50 away from the resting position. Movement of the wire stop member 36 in the floating direction 50 away from the resting position may facilitate removing a crimped assembly of the terminal 20 and the electrical wire 22 from the terminal crimping machine 10. Once the crimped assembly of the terminal 20 and the electrical wire 22 is removed from the terminal crimping machine 10, the wire stop member 36 returns to the resting position via the assistance provided by the biasing force of the biasing mechanism 40 (barring any greater or equal forces providing resistance to movement of the wire stop member 36 in the return direction 52, such as, but not limited to, a person's hand and/or the like).

In addition or alternative to movement in the floating direction 50, engagement between the wire stop member 36 and the electrical wire 22 and/or the terminal 20 may sometimes cause the wire stop member 36 to rotate about the axis of rotation 104 away from the resting position. In addition or alternative, the wire stop member 36 may be rotated about the axis of rotation 104 away from the resting position using any type of drive mechanism, such as, but not limited to, using an electrical motor (not shown), a pneumatic system (not shown), a hydraulic system (not shown), and/or the like. Rotation of the wire stop member 36 about the axis of rotation 104 away from the resting position may facilitate removing a crimped assembly of the terminal 20 and the electrical wire 22 from the terminal crimping machine 10. The wire stop member 36 may be rotated about the axis of rotation 104 back into the resting position manually and/or using any type of drive mechanism, such as, but not limited to, using an electrical motor (not shown), a biasing mechanism (such as, but not limited to, the biasing mechanism 40), a pneumatic system (not shown), a hydraulic system (not shown), and/or the like.

The embodiments described and/or illustrated herein provide a terminal crimping machine wherein a crimped terminal and wire assembly may be less likely to be jammed due to extrusion of the terminal and/or the wire(s) during crimping thereof. The embodiments described and/or illustrated herein provide a wire stop for a terminal crimping machine that may be less likely to be damaged and/or worn by extrusion of a terminal and/or one or more wires during crimping thereof. For example, the embodiments described and/or illustrated herein provide a wire stop having a stop surface that may be less likely to be damaged and/or worn by extrusion of a terminal and/or one or more wires during crimping thereof.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A wire stop assembly for a terminal crimping machine that crimps a terminal to a wire, the terminal crimping machine having a crimping zone and an applicator assembly having a housing, said wire stop assembly comprising:

a wire stop member having a stop surface configured to engage the wire to limit an amount of travel of the wire in the crimping zone, the wire stop member being movable relative to the crimping zone in a floating direction during crimping of the terminal to the wire, wherein the stop surface of the wire stop member moves along a substantially linear path when the wire stop member moves in the floating direction; and a biasing mechanism configured to exert a biasing force on the wire stop member, the biasing force providing a resistance to the movement of the wire stop member in the floating direction, the biasing mechanism being configured to engage the housing such that the biasing mechanism is operatively connected between the housing and the wire stop member to exert the biasing force on the wire stop member.

2. The wire stop assembly according to claim 1 wherein the biasing force acts in a direction that is substantially opposite the floating direction.

3. The wire stop assembly according to claim 1, wherein the wire stop member is movable in a return direction that is substantially opposite the floating direction, the biasing force assisting the movement of the wire stop member in the return direction.

4. The wire stop assembly according to claim 1, wherein the floating direction is substantially parallel to a direction in which the wire is fed into the crimping zone.

5. The wire stop assembly according to claim 1, wherein the biasing mechanism comprises at least one of a spring and a damper.

6. The wire stop assembly according to claim 1, wherein the biasing mechanism comprises a helical spring.

7. The wire stop assembly according to claim 1, wherein a resting position of the stop surface of the wire stop member is adjustable along the floating direction.

8. The wire stop assembly according to claim 1, wherein the wire stop member is moved in the floating direction via engagement with at least one of the terminal and the wire.

9. The wire stop assembly according to claim 1, wherein the wire stop member is rotatable about an axis of rotation.

10. A wire stop assembly for a terminal crimping machine that crimps a terminal to a wire, the terminal crimping machine having a crimping zone, said wire stop assembly comprising:

a wire stop member having a stop surface configured to engage the wire to limit an amount of travel of the wire in the crimping zone, the wire stop member being movable relative to the crimping zone in a floating direction during crimping of the terminal to the wire, wherein the stop surface of the wire stop member moves along a substantially linear path when the wire stop member moves in the floating direction;

a biasing mechanism configured to exert a biasing force on the wire stop member, the biasing force providing a resistance to the movement of the wire stop member in the floating direction; and a wire stop holder holding the wire stop member, wherein the biasing mechanism engages the wire stop holder such that the biasing force is configured to be exerted on the wire stop member.

11. A wire stop assembly for a terminal crimping machine that crimps a terminal to a wire, the terminal crimping machine having a crimping zone, said wire stop assembly comprising:

a wire stop member having a stop surface configured to engage the wire to limit an amount of travel of the wire in the crimping zone, the wire stop member being movable relative to the crimping zone in a floating direction during crimping of the terminal to the wire, wherein the stop surface of the wire stop member moves along a substantially linear path when the wire stop member moves in the floating direction;

a biasing mechanism configured to exert a biasing force on the wire stop member, the biasing force providing a resistance to the movement of the wire stop member in the floating direction; and a wire stop holder holding the wire stop member, the wire stop holder comprising an opening, the biasing mechanism being configured to be received within the opening of the wire stop holder.

* * * * *